US010082749B2

(12) United States Patent
Sato et al.

(10) Patent No.: US 10,082,749 B2
(45) Date of Patent: Sep. 25, 2018

(54) IMAGE FORMING APPARATUS FOR FORMING AND TRANSFERRING A TONER IMAGE

(71) Applicant: CANON KABUSHIKI KAISHA, Tokyo (JP)

(72) Inventors: Noriaki Sato, Mishima (JP); Tetsuichiro Fujimoto, Mishima (JP); Hiromitsu Kumada, Suntou-gun (JP); Tsuyoshi Ogawa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/499,108

(22) Filed: Apr. 27, 2017

(65) Prior Publication Data

US 2017/0315479 A1 Nov. 2, 2017

(30) Foreign Application Priority Data

May 2, 2016 (JP) ..... 2016-092811

(51) Int. Cl.
*G03G 15/16* (2006.01)
*G03G 15/00* (2006.01)

(52) U.S. Cl.
CPC ..... *G03G 15/1665* (2013.01); *G03G 15/1695* (2013.01); *G03G 15/6558* (2013.01)

(58) Field of Classification Search
None
See application file for complete search history.

(56) References Cited

FOREIGN PATENT DOCUMENTS

| | | | | |
|---|---|---|---|---|
| JP | H09-249325 | A | | 9/1997 |
| JP | H11-199084 | A | | 7/1999 |
| JP | 2002-311669 | A | | 10/2002 |
| JP | 2002311669 | A | * | 10/2002 |
| JP | 2004299810 | A | * | 10/2004 |

OTHER PUBLICATIONS

JP_2002311669_A_T MachineTranslation, Koyama et al., Japan, Oct. 2002.*
JP_2004299810_A_T MachineTranslation, Fukuda, Japan, Oct. 2004.*

* cited by examiner

*Primary Examiner* — Victor Verbitsky
(74) *Attorney, Agent, or Firm* — Canon U.S.A., Inc. IP Division

(57) ABSTRACT

An image forming apparatus includes an image forming unit, a transfer portion that transfers a toner image to a transfer material, a first roller disposed upstream of the transfer portion in a conveying direction of the transfer material, and a second roller disposed upstream of the transfer portion and downstream of the first roller. The triboelectric charge polarities of the surfaces of the first and second rollers when the surfaces are triboelectrically charged by contact with the transfer material differ from each other.

13 Claims, 7 Drawing Sheets

IMAGE FORMING APPARATUS FOR FORMING AND TRANSFERRING A TONER IMAGE

BACKGROUND

Field of the Disclosure

The present disclosure generally relates to image forming and, more particularly, to electrophotographic image forming apparatuses, such as copying machines, facsimiles, and printers.

Description of the Related Art

In electrophotographic image forming apparatuses, when paper dust generated from paper that is often used as transfer materials to which images are transferred adheres to a photosensitive member, image defects, such as streaks on the image or blank dots which are uncopied spots of the image, can sometimes occur. For that reason, paper dust is removed to prevent the paper dust from adhering to the photosensitive member.

Japanese Patent Laid-Open No. 9-249325 discloses a configuration for charging a transfer-material conveying roller provided on a transfer-material conveying path to electrostatically attract paper dust.

However, since the configuration disclosed in Japanese Patent Laid-Open No. 9-249325 uses one charged transfer-material conveying roller to collect paper dust, only paper dust that is charged to the opposite polarity to the polarity of the roller can be recovered, so that paper dust that is charged to the opposite polarity to the polarity of the oppositely charged paper dust can sometimes adhere to the photosensitive member.

SUMMARY

An image forming apparatus according to an aspect of the present disclosure includes an image forming unit configured to form a toner image on a photosensitive member, a transfer portion, a first roller, and a second roller. The transfer portion is configured to transfer the toner image formed by the image forming unit to a transfer material. The first roller is disposed upstream of the transfer portion in a conveying direction of the transfer material conveyed to the transfer portion. The first roller conveys the transfer material by coming into contact with a surface of the transfer material to which the toner image is to be transferred. A triboelectric charge polarity of the first roller when the first roller is triboelectrically charged by contact with the transfer material is opposite to a charge polarity of the photosensitive member. The second roller is disposed upstream of the transfer portion and downstream of the first roller in the conveying direction. The second roller conveys the transfer material by coming into contact with the surface of the transfer material to which the toner image is to be transferred. A triboelectric charge polarity of the second roller when the second roller is triboelectrically charged by contact with the transfer material is same as the charge polarity of the photosensitive member.

Further features of the present disclosure will become apparent from the following description of exemplary embodiments with reference to the attached drawings.

DESCRIPTION OF THE EMBODIMENTS

Image forming apparatuses according to one or more embodiments of the present disclosure will be described in detail hereinbelow with reference to the drawings.

First Embodiment

1. Overall Configuration and Operation of Image Forming Apparatus

Figure 1:
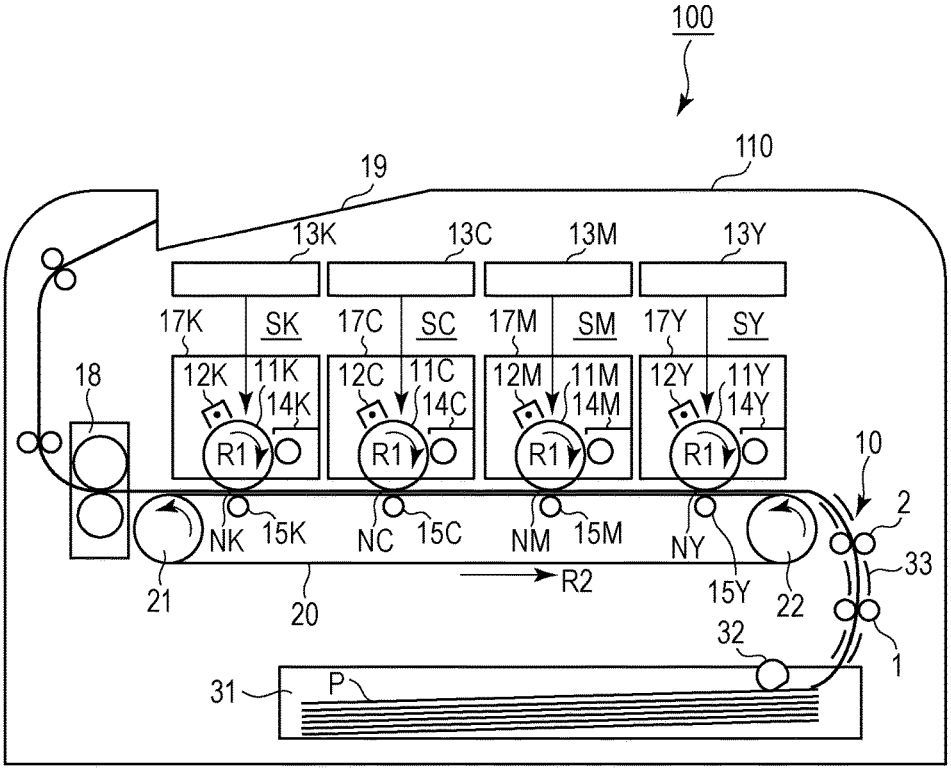
FIG. 1 is a schematic cross-sectional view of an image forming apparatus according to a first embodiment of the present disclosure.

FIG. 1 is a schematic cross-sectional view of an image forming apparatus 100 of a first embodiment. The image forming apparatus 100 of the present embodiment is a tandem color laser printer capable of forming full-color images using an electrophotographic process. In particular, the image forming apparatus 100 of the present embodiment employs an electrostatic transportation belt (ETB) system for conveying transfer materials using a belt.

The image forming apparatus 100 includes as a plurality of image forming units (stations)-first, second, third, and fourth image forming units SY, SM, SC, and SK that respectively form yellow, magenta, cyan, and black color images. Components having the same or corresponding function or configuration of these four image forming units SY, SM, SC, and SK are sometimes described comprehensively by omitting the last signs Y, M, C, and K indicating colors. An image forming unit S includes a photosensitive member 11, a charging unit 12, an exposure unit 13, a developing unit 14, a transfer roller 15, and so on, described later. As used herein, the term "unit" generally refers to hardware, firmware, software or a component, such as circuitry, alone or in combination thereof, that is used to effectuate a purpose.

The rotatable drum-shaped photosensitive member (an electrophotographic photosensitive member) 11 is rotationally driven in the direction of arrow R1 (clockwise) in the drawing. The surface of the rotating photosensitive member 11 is charged to a predetermined potential of a predetermined polarity (a positive polarity in this embodiment) by a corona charging unit (hereinafter also simply referred to as "charging unit") 12 serving as a charger. The surface of the charged photosensitive member 11 is scanned and exposed to a laser beam according to image information by an exposure unit (scanner unit) 13 to form an electrostatic latent image (an electrostatic image) on the photosensitive member 11. In the present embodiment, the charging unit 12 and the exposure unit 13 constitute an electrostatic-image forming unit.

The electrostatic latent image formed on the photosensitive member 11 is developed (visualized) by the developing unit 14 using a toner serving as a developer to form a toner image on the photosensitive member 11. The developing unit 14 includes a developing roller serving as a developer bearing member that bears a developer to convey it to a portion (a developing portion) facing the photosensitive member 11. During the developing process, a predetermined developing bias (developing voltage) is applied to the developing roller. As a result, the toner is supplied from the developing roller to the photosensitive member 11 according to the electrostatic latent image on the photosensitive member 11 due to a potential difference between the photosensitive member 11 and the developing roller to form a toner image on the photosensitive member 11. In the present embodiment, toner charged to the same polarity (positive polarity in the present embodiment) as the charge polarity of the photosensitive member 11 adheres to the exposed portion on the photosensitive member 11 whose absolute value of the potential has decreased because it is uniformly charged and then exposed to light.

An endless transfer belt 20 serving as a transfer-material bearing member is opposed to the photosensitive members 11. The transfer belt 20 is stretched round the driving roller 21 and the tension roller 22 and rotates in the direction of arrow R2 (counterclockwise) in the drawing as the driving roller 21 is rotationally driven. The transfer rollers 15 serving as transfer units are disposed on the inner circumferential surface of the transfer belt 20 in correspondence with the individual photosensitive members 11. Each transfer roller 15 is pushed (urged) to the photosensitive member 11 via the transfer belt 20 to form a transfer portion N at which the photosensitive member 11 and the transfer belt 20 come into contact with each other.

The toner image formed on the photosensitive member 11, as described above, is transferred to a transfer material (sheet) P that is carried and conveyed by the transfer belt 20 and conveyed at the transfer portion N by the action of the transfer roller 15. During the transfer process, a transfer bias (transfer voltage) having a polarity (negative polarity in the present embodiment) opposite to the charge polarity (regular charge polarity) of the toner at the development is applied to the transfer roller 15. For example, in forming a full color image, yellow, magenta, cyan, and black images formed on the individual photosensitive members 11 are sequentially transferred onto the transfer material P carried by the transfer belt 20 so as to overlap each other.

The transfer material P is stored in a cassette 31 serving as a storage unit. The transfer material P in the cassette 31 is picked up by a feed roller 32 and is fed out to a conveying path 33. The transfer material P fed out to the conveying path 33 is conveyed to the transfer belt 20 by a first conveying roller pair 1 and a second conveying roller pair 2. In the present embodiment, the first and second conveying roller pairs 1 and 2 constitute a paper-dust removing mechanism 10. The paper-dust removing mechanism 10 will be described later in detail.

The transfer material P to which the toner image is transferred is separated from the transfer belt 20 and is conveyed to a thermal fixing unit 18 serving as a fuser. After the toner image is fixed (melted and fixed) to the transfer material P by being heated and pressed by the thermal fixing unit 18, the transfer material P is discharged to a discharge tray 19 outside the apparatus main body 110 of the image forming apparatus 10.

The image forming apparatus 100 of the present embodiment employs a photosensitive-member cleanerless configuration in which toner (untransferred toner) remaining on the surface of the photosensitive member 11 after the transfer process is recovered to the developing unit 14. In other words, the untransferred toner on the photosensitive member 11 is charged to the regular charge polarity while passing through the charged portion of the photosensitive member 11 charged by the charging unit 12. The untransferred toner is transferred to the developing roller due to the potential difference between the photosensitive member 11 ad the developing roller of the developing unit 14 while passing through the developing portion and is recovered by the developing unit 14. This can be performed at the same time the electrostatic latent image on the photosensitive member 11 is developed. In other words, the toner is transferred from the developing roller to the portion of the electrostatic latent image on the photosensitive member 11 due to the potential difference between the photosensitive member 11 and the developing roller, and the untransferred toner adhering to a non-image portion is transferred to the developing roller.

In the present embodiment, in each image forming unit S, which may include one or more memories and one or more processors, the photosensitive member 11, and the charging unit 12 and developing unit 14 serving as processing units for the photosensitive member 11 constitute a process cartridge 17 that can be detachably mounted to the apparatus main body 110 in a unified manner.

2. Paper-Dust Removing Mechanism

Figure 2:
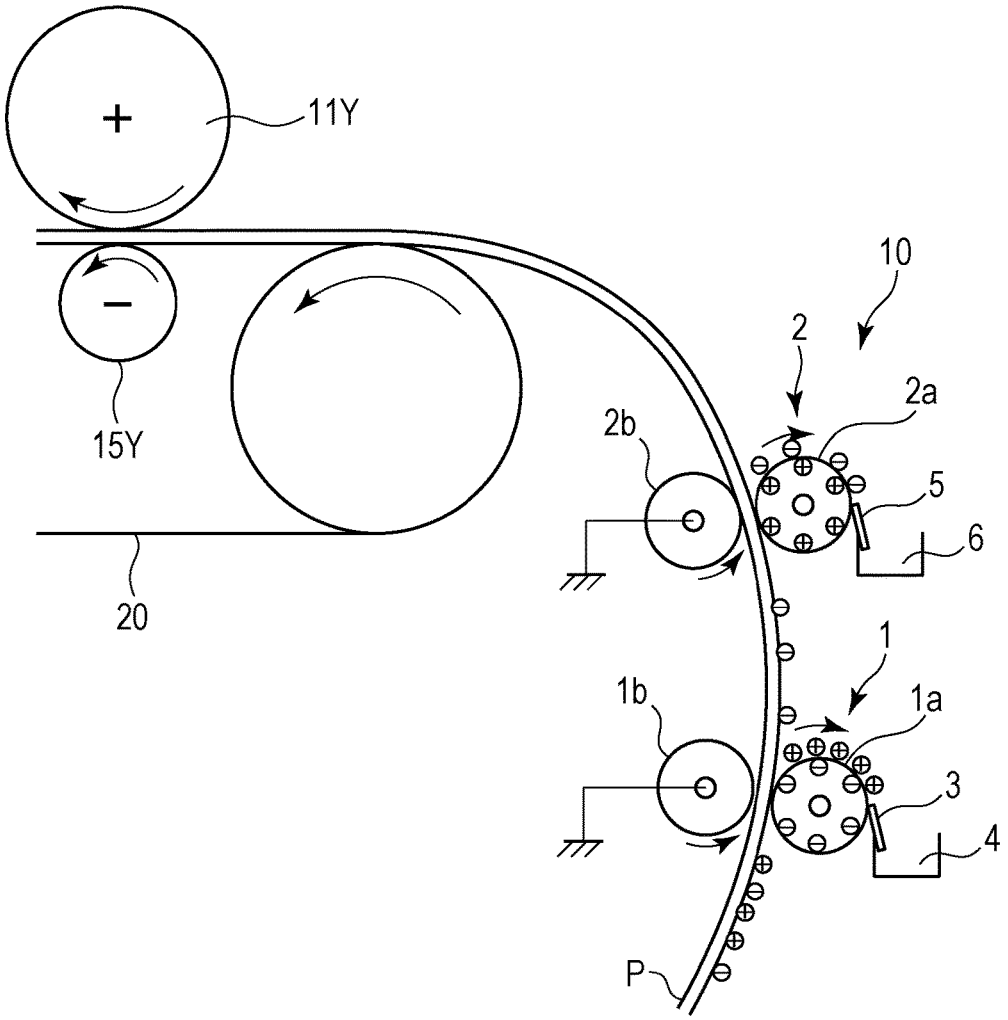
FIG. 2 is a schematic cross-sectional view of the vicinity of a paper-dust removing mechanism of the first embodiment.

Next, the paper-dust removing mechanism 10 of the present embodiment will be described. FIG. 2 is a schematic cross-sectional view of the vicinity of the paper-dust removing mechanism 10 of the present embodiment.

Here, a surface of the transfer material P to which a toner image is transferred immediately after the transfer material P passes through the paper-dust removing mechanism 10 is referred to as "image forming surface", and a surface of the transfer material P opposite to the image forming surface is referred to as "back surface". Here, it is assumed that the transfer material P is paper. This is because paper is often used as the transfer material P in the electrophotographic image forming apparatus 10, in which case paper dust generated from the transfer material P is noticeable. In addition to paper, the image forming apparatus 10 can form images also on, for example, a plastic sheet and cloth, as the transfer material P and output the images. In the present embodiment, both the charge polarity of the photosensitive member 11 and the regular charge polarity of the toner are positive.

While the transfer material P is being conveyed, the transfer material P and rollers that convey the transfer material P and the components on the conveying path rub each other to flake off cellulose-based pulp fibers from the transfer material P, generating paper dust. The paper dust can contain a filler that has come off the transfer material P. Much of the paper dust is charged to positive or negative polarity by rubbing against the rollers that convey the transfer material P and the conveying path.

In the present embodiment, the paper-dust removing mechanism 10 is constituted by the first and second conveying roller pairs 1 and 2 disposed on the conveying path 33 from the feed roller 32 to the transfer belt 20 and first and second sheets 3 and 5 and first and second trays 4 and 6, described later.

The first conveying roller pair 1 includes a first roller 1*a* in contact with the image forming surface of the transfer material P and a first facing roller 1*b* facing the first roller 1*a* and in contact with the back surface of the transfer material P. In the present embodiment, the first roller 1*a* and the first facing roller 1*b* are pushed (urged) to each other and are individually rotationally driven. A surface (an outer circumferential surface) of the first roller 1*a* is formed of a member that is charged to negative polarity by rubbing against the transfer material P. In the present embodiment, the surface of the first roller 1*a* is made of tetrafluoroethylene-perfluoroalkyl vinyl ether copolymer (hereinafter referred to as "PFA") which is more triboelectrically negative than the transfer material P.

The surface of the first roller 1*a* is charged to negative polarity by rubbing against the transfer material P while the transfer material P is passing through the first conveying roller pair 1. As a result, positively charged paper dust adhering to the image forming surface of the transfer material P is electrostatically attracted to the negatively charged surface of the first roller 1*a* to move to the surface of the first roller 1*a*, thus being removed from the surface of the transfer material P. The paper dust of positive polarity that has moved onto the first roller 1*a* is scraped from the surface of the rotating first roller 1*a* by the first sheet 3 serving as a removing member disposed in contact with the surface of the first roller 1*a* and is stored in the first tray 4 serving as a recovery container. Paper dust of negative polarity that has not been attracted to the first roller 1*a* passes through the first roller 1*a* and remains on the transfer material P.

The second conveying roller pair 2 is disposed downstream of the first conveying roller pair 1 in the conveying direction of the transfer material P. The second conveying roller pair 2 includes a second roller 2*a* in contact with the image forming surface of the transfer material P and a second facing roller 2*b* facing the second roller 2*a* and in contact with the back surface of the transfer material P. In the present embodiment, the second roller 2*a* and the second facing roller 2*b* are pushed (urged) to each other and are individually rotationally driven. The surface of the second roller 2*a* is made of a member that is charged to positive polarity by rubbing against the transfer material P. In the present embodiment, the surface of the second roller 2*a* is made of nylon which is more triboelectrically positive than the transfer material P.

The surface of the second roller 2*a* is charged to positive polarity by rubbing against the transfer material P while the transfer material P is passing through the second conveying roller pair 2. As a result, the negatively charged paper dust that has not been recovered by the first roller 1*a* and remains on the image forming surface of the transfer material P is electrostatically attracted to the positively charged surface of the second roller 2*a* to move to the surface of the second roller 2*a*, thus being removed from the upper surface of the transfer material P. The paper dust of negative polarity that has moved onto the second roller 2*a* is scraped from the surface of the rotating second roller 2*a* by the second sheet 5 serving as a removing member disposed in contact with the surface of the second roller 2*a* and is stored in the first tray 6 serving as a recovery container.

As described above, the image forming apparatus 100 of the present embodiment includes the first roller 1*a* that is disposed upstream of the transfer portion N in the conveying direction of the transfer material P conveyed to the transfer portion N and that conveys the transfer material P in contact with the surface to which the toner image on the transfer material P is transferred. The image forming apparatus 100 also includes the second roller 2*a* that is disposed upstream of the transfer portion N and downstream of the first roller 1*a* and that conveys the transfer material P in contact with the surface of the transfer material P to which the toner image is transferred. The frictional charge polarities of the surfaces of the first and second rollers 1*a* and 2*a* charged by contact with the transfer material P differ from each other. This allows the positively charged paper dust and the negatively charged paper dust to be removed from the image forming surface of the transfer material P.

In the present embodiment, the charge polarity of the second roller 2*a* disposed on the downstream side is set to the same as the charge polarity of the photosensitive member 11. In other words, the triboelectric charge polarity of the surface of the second roller 2*a* when charged by contact with the transfer material P is the same as the charge polarity of the photosensitive member 11. The reason is that, when paper dust of the same polarity as the polarity of the second roller 2*a* is generated on the image forming surface of the transfer material P conveyed between the first conveying roller pair 1 and the second conveying roller pair 2, the paper dust cannot be removed by the second roller 2*a*. For example, positively charged paper dust can be newly generated on the image forming surface of the transfer material P conveyed between the first conveying roller pair 1 and the second conveying roller pair 2 due to, for example, contact with the conveying path. Furthermore, the charge polarity of paper dust remaining on the transfer material P after the transfer material P passes through the first conveying roller pair 1 can change from negative polarity to positive polarity due to contact with the conveying path etc. In such cases, paper dust of the same polarity as the polarity of the second roller 2*a* cannot be removed by the second roller 2*a*. However, when the charge polarity of the second roller 2*a* is the same as the charge polarity of the photosensitive member 11, the unremovable paper dust is substantially only paper dust charged to the same polarity as the polarity of the photosensitive member 11. This further prevents paper dust from adhering to the photosensitive member 11 as compared with a case where the paper dust has a polarity opposite to the photosensitive member 11.

In the present embodiment, PFA is used as the material of the surface of the first roller 1*a*. Another material that is charged to negative polarity by contact with the transfer material P may be used. To be charged to negative polarity by contact with the transfer material P, the first roller 1*a* may be more triboelectrically negative than the transfer material P and be sufficiently separate from the transfer material P on the triboelectric series. A material (for example, acryl) that is more triboelectrically negative than gold may be used to be sufficiently charged to negative polarity by contact with the transfer material P. Whether the material is more triboelectrically negative than gold is determined by rubbing a grounded gold flat plate with a flat plate made of an evaluation target material and determining whether the surface of the evaluation target material is charged to positive or negative polarity.

In the present embodiment, nylon is used as the material of the surface of the second roller 2*a*. Another material that is charged to positive polarity by contact with the transfer material P may be used. To be charged to positive polarity by contact with the transfer material P, the second roller 2*a* may be more triboelectrically positive than the transfer material P and be sufficiently separate from the transfer material P on the triboelectric series. A material (for example, glass) that is more triboelectrically positive than zinc may be used to be sufficiently charged to positive polarity by contact with the transfer material P. Whether the material is more triboelectrically positive than zinc is determined by rubbing a grounded zinc flat plate with a flat plate made of an evaluation target material and determining whether the surface of the evaluation target material is charged to positive or negative polarity.

Evaluating the triboelectric rank of the transfer material P mainly used in the image forming apparatus 100 reduces troubles caused by paper dust adhering to the photosensitive member 11 in many cases. Alternatively, the triboelectric rank of the transfer material P can be evaluated for a specific kind of transfer material P (attribute such as plain paper, cardboard, or coated paper, manufacturer, item number, or the like) that reduces troubles caused by paper dust adhering to the photosensitive member 11.

Thus, of the first and second rollers 1*a* and 2*a*, the surface of the second roller 2*a* may be formed of a material that is more triboelectrically positive than zinc, and the surface of the first roller 1*a* may be formed of a material that is more triboelectrically negative than gold.

In contrast, the material of the surface of the first facing roller 1*b* may be any material. However, the material of the surface of the first facing roller 1*b* may be more triboelectrically positive than the material of the surface of the first roller 1*a*. In other words, the triboelectric charge polarity of the surface of the first roller 1*a* that is triboelectrically charged by contact with the first facing roller 1*b* and the triboelectric charge polarity of the surface of the first roller 1*a* that is triboelectrically charged by contact with the transfer material P may be the same. Thus, the first roller 1*a* and the first facing roller 1*b* come into contact with each other and rotate at the time before the transfer material P passes therethrough, whereby the surface of the first roller 1*a* can be charged to negative polarity. This improves the paper dust removing performance. The first facing roller 1*b* is electrically grounded (connected to the ground [GND]).

Similarly, the material of the surface of the second facing roller 2*b* may be any material. However, the material of the surface of the second facing roller 2*b* may be more triboelectrically negative than the material of the surface of the second roller 2*a*. In other words, the triboelectric charge polarity of the surface of the second roller 2*a* that is triboelectrically charged by contact with the second facing roller 2*b* and the triboelectric charge polarity of the surface of the second roller 2*a* that is triboelectrically charged by contact with the transfer material P may be the same. Thus, the second roller 2*a* and the second facing roller 2*b* come into contact with each other and rotate at the time before the transfer material P passes therethrough, whereby the surface of the second roller 2*a* can be charged to positive polarity. This improves the paper dust removing performance. The second facing roller 2*b* is electrically grounded.

The first second conveying roller pairs 1 and 2 may have a function other than removing paper dust. For example, a registration roller pair may be used to more correctly align the position of the toner image with the position of the transfer material P. The registration roller pair temporarily stops conveyance of the transfer material P between the feed roller 32 and the transfer belt 20 and feeds it again at synchronous timing or finely adjusts the skew or conveying speed of the transfer material P. The first conveying roller pair 1 or the second conveying roller pair 2 may also serve as the registration roller pair. In other words, the first roller 1*a* or the second roller 2*a* may also serve as the registration roller for use in adjusting the conveyance timing or conveyance position of the transfer material P.

As described above, according to the present embodiment, paper dust is removed from the image forming surface of the transfer material P by the paper-dust removing mechanism 10, reducing image defects due to paper dust adhering to the photosensitive member 11. In particular, the first and second rollers 1*a* and 2*a* constituting the paper-dust removing mechanism 10 are charged to different polarities to attract both of positively charged paper dust and negatively charged paper dust, removing them from the image forming surface of the transfer material P. Furthermore, since the first and second rollers 1*a* and 2*a* are triboelectrically charged due to the difference in triboelectric rank from the transfer material P, there is no need for a charger that charges the first and second rollers 1*a* and 2*a* and a power supply for applying voltage. This reduces the manufacturing cost of the image forming apparatus 100 and suppresses complication of the apparatus configuration. Furthermore, there is no need to provide a device for removing paper dust on the photosensitive member 11 in the cartridge 17, reducing the size or and increasing the capacity of the cartridge 17. Since the cartridges 17Y, 17M, 17C, and 17K for the individual colors can have the same configuration, the same manufacturing facility can be shared, reducing the manufacturing cost. In particular, the need for reducing paper dust adhering to the photosensitive member 11 is higher in the photosensitive-member cleaner-less image forming apparatus 100 than in a configuration including a photosensitive-member cleaning unit that removes untransferred toner from the photosensitive member 11. Therefore, the effect of reducing image defects due to paper dust adhering to the photosensitive member 11 using the paper-dust removing mechanism 10 is larger in the photosensitive member cleaner-less image forming apparatus 100 than in the configuration including a photosensitive-member cleaning unit that removes untransferred toner from the photosensitive member 11.

Second Embodiment

Next, another embodiment of the present disclosure will be described. The basic configuration and operation of the image forming apparatus of the present embodiment are the same as those of the first embodiment. Therefore, components having the same or corresponding functions as those of the first embodiment are given the same reference signs, and detailed descriptions will be omitted.

Figure 3:
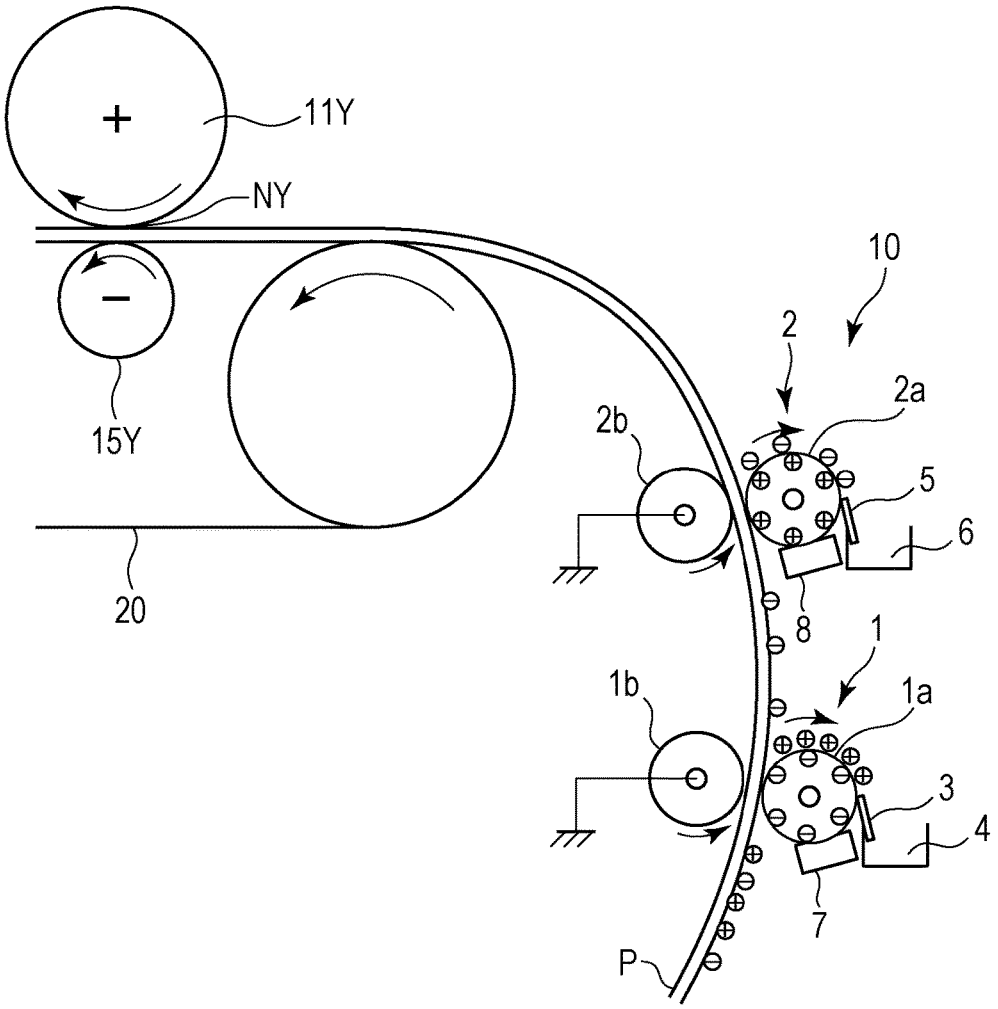
FIG. 3 is a schematic cross-sectional view of the vicinity of a paper-dust removing mechanism according to a second embodiment of the present disclosure.

FIG. 3 is a schematic cross-sectional view of the vicinity of a paper-dust removing mechanism 10 according to the present embodiment. In addition to the configuration of the first embodiment, the paper-dust removing mechanism 10 of the present embodiment includes a first friction member 7 disposed in contact with the first roller 1*a* and a second friction member 8 disposed in contact with the second roller 2*a*. The first friction member 7 is in contact with the first roller 1*a* downstream of the contact portion between the first roller 1*a* and the first sheet 3 and upstream of the contact portion between the first roller 1*a* and the transfer material P in the direction of rotation of the first roller 1*a*. The second friction member 8 is in contact with the second roller 2*a* downstream of the contact portion between the second roller 2*a* and the second sheet 5 and upstream of the contact portion between the second roller 2*a* and the transfer material P in the direction of rotation of the second roller 2*a*.

The triboelectric charge polarity of the surface of the first roller 1*a* that is triboelectrically charged by contact with the first friction member 7 and the triboelectric charge polarity of the surface of the first roller 1*a* that is triboelectrically charged by contact with the transfer material P are the same. The triboelectric charge polarity of the surface of the second roller 2*a* that is triboelectrically charged by contact with the second friction member 8 and the triboelectric charge polarity of the surface of the second roller 2*a* that is triboelectrically charged by contact with the transfer material P are the same. In other words, the polarity of the surface of the first roller 1*a* that is triboelectrically charged by the first friction member 7 and the polarity of the surface of the second roller 2*a* that is triboelectrically charged by the second friction member 8 differ from each other. The polarity of the surface of the second roller 2*a* that is triboelectrically charged by the second friction member 8 is the same as the charge polarity of the photosensitive member 11.

To further explain it, the material of the surface of the first roller 1*a* is PFA, as in the first embodiment. In the present embodiment, the material of the surface (the entire surface in the present embodiment) of the first friction member 7 that is in contact with the first roller 1*a* is nylon, which is more triboelectrically positive than the material of the surface of the first roller 1*a*. This causes the surface of the first roller 1*a* to be charged to negative polarity by friction with the first friction member 7. The material of the surface of the second roller 2*a* is nylon, as in the first embodiment. In the present embodiment, the material of the surface (the entire surface in the present embodiment) of the second friction member 8 that is in contact with the second roller 2*a* is acryl, which is more triboelectrically negative than the material of the surface of the second roller 2*a*. This causes the surface of the second roller 2*a* to be charged to positive polarity by friction with the second friction member 8.

Thus, also in the present embodiment, the first roller 1*a* and the second roller 2*a* can be oppositely charged, as in the first embodiment, so that paper dust that is charged to positive polarity and negative polarity can be removed from the image forming surface of the transfer material P, providing the same advantageous effect as that of the first embodiment. In the present embodiment, the polarity of the surface of the second roller 2*a* on the downstream side, which is triboelectrically charged by the second friction member 8, is set the same as the charge polarity of the photosensitive member 11. This is because of the same reason as described in the first embodiment. In the present embodiment, the first and second rollers 1*a* and 2*a* are respectively charged by friction with the first and second friction members 7 and 8, which provides the advantage of being stably charged regardless of the kind of the transfer material P. Furthermore, in the present embodiment, the charge polarities of the first and second rollers 1*a* and 2*a* depend on the materials of the first and second friction members 7 and 8, respectively. This allows, for example, the surfaces of the first roller 1*a* and the second roller 2*a* to be formed of the same material, providing the advantage of increasing the flexibility of design.

Third Embodiment

Next, still another embodiment of the present disclosure will be described. In the present embodiment, components having the same or corresponding functions as those of the first embodiment are given the same reference signs, and detailed descriptions will be omitted.

1. Overall Configuration and Operation of Image Forming Apparatus

Figure 4:
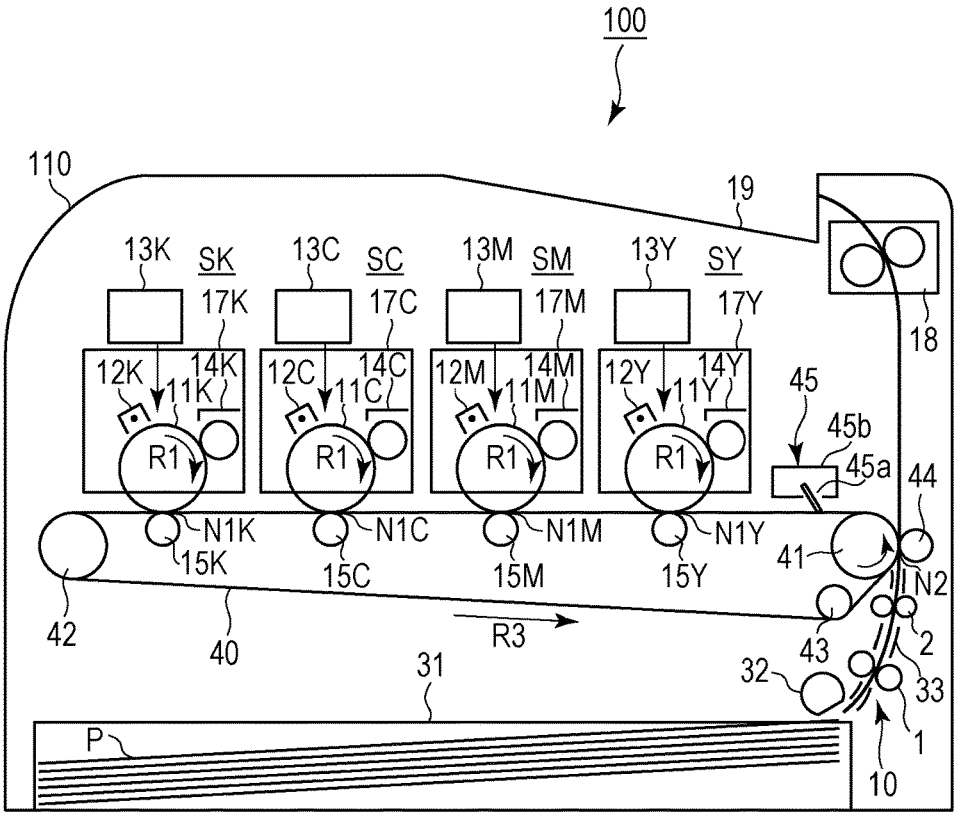
FIG. 4 is a schematic cross-sectional view of an image forming apparatus according to a third embodiment of the present disclosure.

FIG. 4 is a schematic cross-sectional view of an image forming apparatus 100 of the present embodiment. The image forming apparatus 100 of the present embodiment employs an intermediate transfer belt (ITB) system.

In the present embodiment, each image forming unit S includes the photosensitive member 11 serving as a first image bearing member, the charging unit 12, the exposure unit 13, the developing unit 14, and a primary transfer roller 15, described later. In the present embodiment, both the charge polarity of the photosensitive member 11 and the regular charge polarity of the toner are negative, and a toner image is formed by reversal processing.

The image forming apparatus 100 of the present embodiment includes an endless intermediate transfer belt 40 serving as a second image bearing member opposed to the individual photosensitive members 11. The intermediate transfer belt 40 is an example of a movable intermediate transfer member that transfers a toner image transferred from the photosensitive member 11 to the transfer material P at a transfer portion. The intermediate transfer belt 40 is stretched round a driving roller (a secondary transfer facing roller) 41, a tension roller 42, and an idler roller 43 and rotates (runs) in the direction of arrow R3 (counterclockwise) in the drawing as the driving roller 41 is rotationally driven. The primary transfer rollers 15 serving as primary transfer units are disposed on the inner circumferential surface of the intermediate transfer belt 40 in correspondence with the individual photosensitive members 11. Each primary transfer roller 15 is pushed (urged) to the photosensitive member 11 via the intermediate transfer belt 40 to form a primary transfer portion N1 at which the photosensitive member 11 and the intermediate transfer belt 40 come into contact with each other. Furthermore, on an outer circumferential surface of the intermediate transfer belt 40, a secondary transfer roller 44 serving as a secondary transfer unit is disposed at a position facing the driving roller 41. The secondary transfer roller 44 is pushed (urged) to the driving roller 41 via the intermediate transfer belt 40 to form a secondary transfer portion N2 at which the intermediate transfer belt 40 and the secondary transfer roller 44 come into contact with each other.

A toner image formed on the photosensitive member 11 is primarily transferred onto the intermediate transfer belt 40 at the primary transfer portion N1 by the action of the primary transfer roller 15. During the primary transfer process, a primary transfer bias (primary transfer voltage) having a polarity (positive polarity in the present embodiment) opposite to the regular charge polarity of the toner is applied to the primary transfer roller 15. For example, in forming a full color image, yellow, magenta, cyan, and black images formed on the individual photosensitive members 11 are sequentially transferred onto the intermediate transfer belt 40 so as to overlap each other. Toner (primary untransferred toner) remaining on the surface of the photosensitive member 11 after the primary transfer process is recovered by the developing unit 14.

The toner image formed on the intermediate transfer belt 40 is secondarily transferred to the transfer material P, at the secondary transfer portion N2, which is nipped between the intermediate transfer belt 40 and the secondary transfer roller 44, and conveyed by the action of the secondary transfer roller 44. During the secondary transfer process, a secondary transfer bias (secondary transfer voltage) opposite to the regular charge polarity of the toner (positive polarity in the present embodiment) is applied to the secondary transfer roller 44. The transfer material P is fed from the cassette 31 by the feed roller 32, as in the first embodiment, and is conveyed to the secondary transfer portion N2 by the first and second conveying roller pairs 1 and 2. The transfer material P to which the toner image is transferred is subjected to fixing process, as in the first embodiment, and is thereafter discharged to the discharge tray 19.

Toner (secondary untransferred toner) remaining on the surface of the intermediate transfer belt 40 after the secondary transfer process is removed from the surface of the intermediate transfer belt 40 by a belt cleaning unit 45 serving as an intermediate-transfer-member cleaning unit for recovery. The belt cleaning unit 45 scrapes the secondary untransferred toner from the surface of the moving intermediate transfer belt 40 using a cleaning blade 45*a* disposed in contact with the intermediate transfer belt 40 and stores the secondary untransferred toner in a recovery container 45*b*. The cleaning blade 45*a* is one example of a cleaning member that is in contact with the intermediate transfer belt 40 downstream of the secondary transfer portion N2 and upstream of the primary transfer portion N1 in the moving direction of the intermediate transfer belt 40 to remove the toner from the intermediate transfer belt 40.

In such an image forming apparatus 100, paper dust adhering to the image forming surface of the transfer material P can move to the intermediate transfer belt 40 at the secondary transfer portion N2, and the paper dust can adhere to the cleaning blade 45*a* for recovering the secondary untransferred toner. In this case, the paper dust is bitten between the cleaning blade 45*a* and the intermediate transfer belt 40 to form a gap between the cleaning blade 45*a* and the intermediate transfer belt 20, causing the intermediate transfer belt 40 to fail in cleaning. Furthermore, paper dust that has passed by the cleaning blade 45*a* through the gap can adhere to the photosensitive member 11, causing image defects.

2. Paper-Dust Removing Unit

Figure 5:
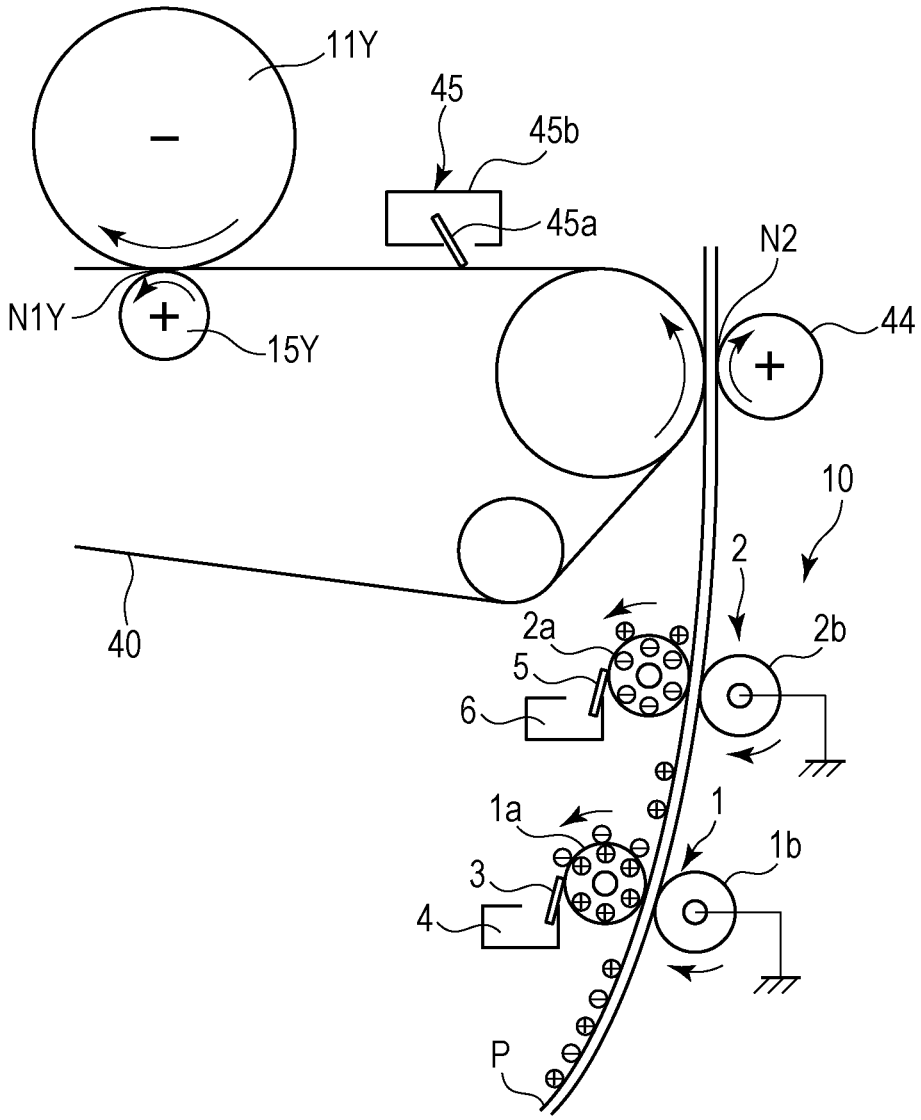
FIG. 5 is a schematic cross-sectional view of the vicinity of a paper-dust removing unit of the third embodiment.

Next, a paper-dust removing unit 10 of the present embodiment will be described. FIG. 5 is a schematic cross-sectional view of the vicinity of the paper-dust removing unit 10 of the present embodiment. The paper-dust removing unit 10 of the present embodiment has the same configuration as that of the paper-dust removing unit 10 of the first embodiment. However, both the charge polarity of the photosensitive member 11 and the regular charge polarity of the toner of the present embodiment are negative. For that reason, the present embodiment is configured so that the first roller 1*a* on the upstream side is positively charged, and the second roller 2*a* on the downstream side is negatively charged.

In other words, in the present embodiment, the surface of the first roller 1*a* is formed of a member that is charged to positive polarity by rubbing with the transfer material P. In the present embodiment, the material of the surface of the first roller 1*a* is nylon which is more triboelectrically positive than the transfer material P. In the present embodiment, the surface of the second roller 2*a* is made of a member that is charged to negative polarity by rubbing with the transfer material P. In the present embodiment, the surface of the second roller 2*a* is made of PFA which is more triboelectrically negative than the transfer material P.

This configuration allows the positively charged paper dust and the negatively charged paper dust to be removed from the image forming surface of the transfer material P. Furthermore, in the present embodiment, the charge polarity of the second roller 2*a* is set to the same as the charge polarity of the photosensitive member 11, as in the first embodiment. In other words, only paper dust that is charged to negative polarity, which is the same polarity as that of the photosensitive member 11, cannot be removed by the second roller 2*a*. At the secondary transfer portion N2, a secondary transfer bias of positive polarity that is opposite to the charge polarity of the photosensitive member 11 is applied to the secondary transfer roller 44. This prevents the negatively charged paper dust that has not been removed by the second roller 2*a* from adhering to the intermediate transfer belt 40. This prevents the paper dust from reaching the cleaning blade 45*a* and the photosensitive member 11. This prevents the cleaning failure of the intermediate transfer belt 40 due to paper dust adhering to the cleaning blade 45*a* and image defects due to paper dust adhering to the photosensitive member 11. Furthermore, even if the negatively charged paper dust moves to the intermediate transfer belt 40 and passes by the cleaning blade 45*a* onto the primary transfer portion N1, adhesion of the paper dust to the photosensitive member 11 can be prevented because the paper dust is charged to the same polarity as that of the photosensitive member 11.

Also the present embodiment may include the first and second friction members 7 and 8 for triboelectrically charging the first and second rollers 1*a* and 2*a* described in the second embodiment. In this case, the present embodiment may be configured so that the first friction member 7 triboelectrically charges the first roller 1*a* to positive polarity and the second friction member 8 triboelectrically charges the second roller 2*a* to the negative polarity.

Other Embodiments

Having described the present disclosure based on specific embodiments, it is to be understood that the present disclosure is not limited to the above embodiments.

Figure 6:
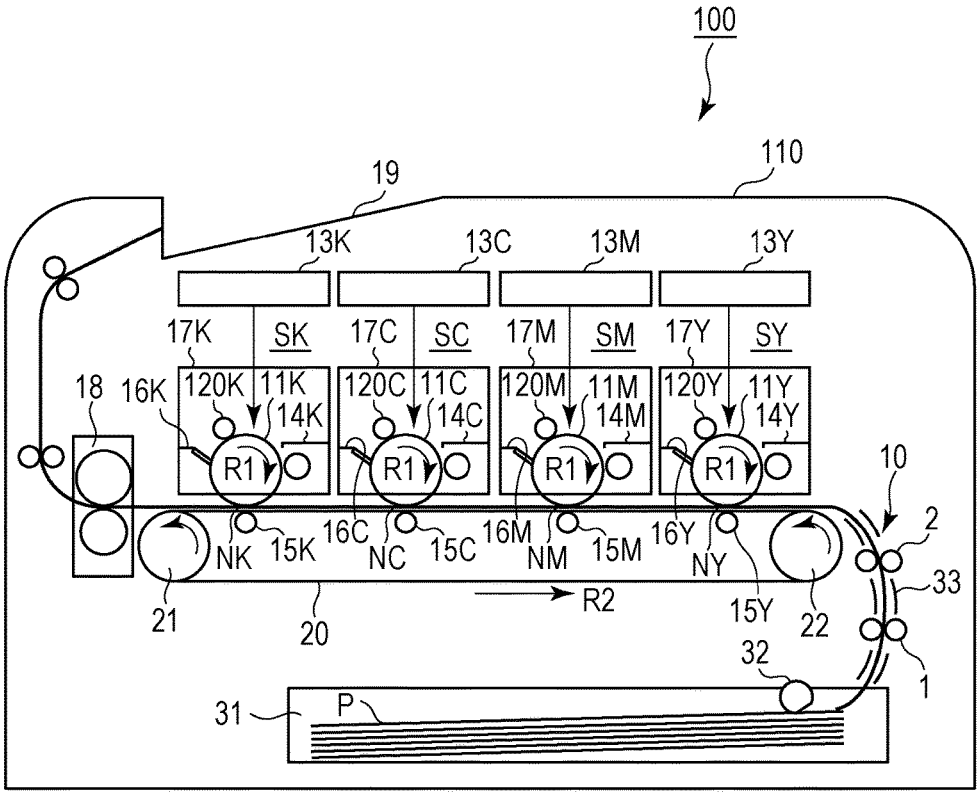
FIG. 6 is a schematic cross-sectional view of an image forming apparatus according to another embodiment of the present disclosure.
Figure 7:
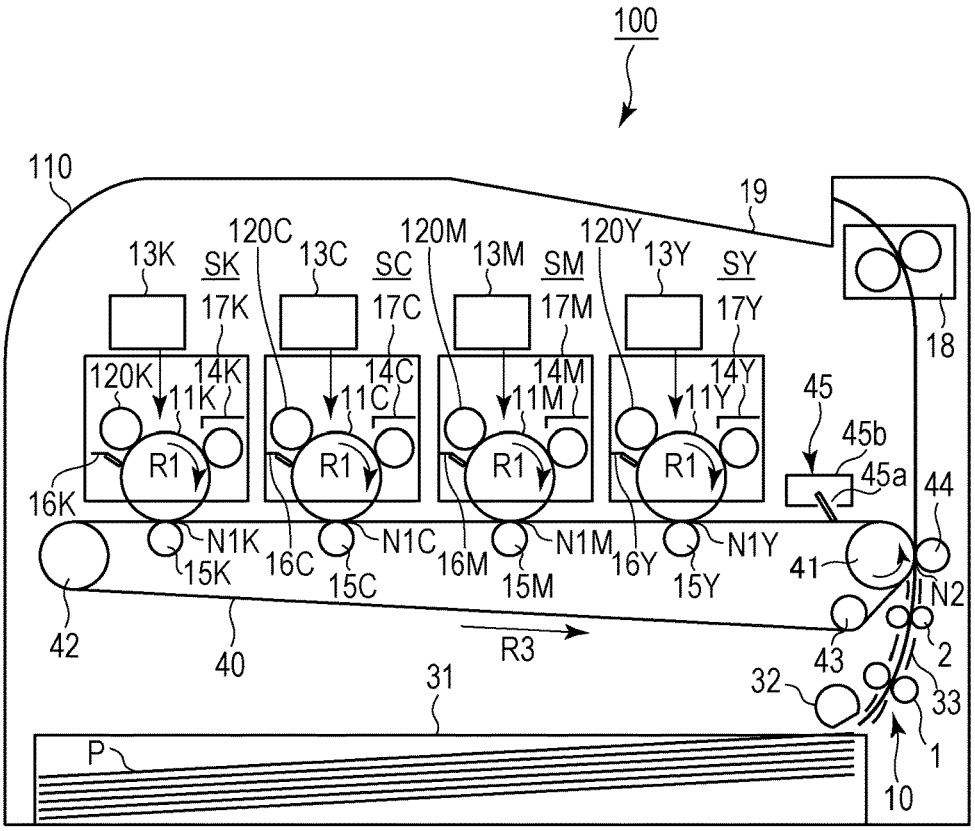
FIG. 7 is a schematic cross-sectional view of an image forming apparatus according to still another embodiment of the present disclosure.

In the above embodiments, the image forming apparatuses employ a photosensitive-member cleanerless configuration. However, the present disclosure may also be applied to a configuration including a photosensitive-member cleaning unit that removes untransferred toner from the photosensitive member. FIGS. 6 and 7 illustrate examples in which the present disclosure is applied to the configuration of an image forming apparatus including a photosensitive-member cleaning unit. FIG. 6 illustrates a case in which the ETB system is employed, as in the image forming apparatus 100 of FIG. 1. FIG. 7 illustrates a case in which the ITB system is employed, as in the image forming apparatus 100 of FIG. 4. In the image forming apparatuses 100 of FIGS. 6 and 7, components having the same or corresponding functions as those of the image forming apparatuses 100 of FIGS. 1 and 4 are given the same reference signs. In the image forming apparatuses 100 in FIGS. 6 and 7, untransferred toner remaining on the photosensitive member 11 after a toner image is transferred from the photosensitive member 11 to a transfer target (the transfer material P or the intermediate transfer member 40) is removed from the upper surface of the photosensitive member 11 by a photosensitive-member cleaning unit 16 for recovery. The photosensitive-member cleaning unit 16 scrapes the untransferred toner from the surface of the moving photosensitive member 11 using a cleaning blade disposed in contact with the photosensitive member 11. The image forming apparatuses 100 in FIGS. 6 and 7 each include charge rollers 120 serving as chargers each of which charges a corresponding photosensitive member 11. In the image forming apparatuses 100 of FIGS. 6 and 7, when paper dust adheres to the photosensitive member 11, the paper dust can adhere to the cleaning blade of the photosensitive-member cleaning unit 16 and can be bitten between the cleaning blade and the photosensitive member 11. This forms a gap between the cleaning blade and the photosensitive member 11 to cause cleaning failure or image defects due to paper dust that has passed by the cleaning blade through the gap. Thus, also for image forming apparatuses with such configurations, it is effective to prevent paper dust from adhering to the photosensitive member 11 using the paper-dust removing mechanism 10.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-092811 filed May 2, 2016, which is hereby incorporated by reference herein in its entirety.

What is claimed is:

1. An image forming apparatus comprising:

an image forming unit configured to form a toner image on a photosensitive member;

a transfer portion configured to transfer the toner image formed by the image forming unit to a transfer material;

a first roller disposed upstream of the transfer portion in a conveying direction of the transfer material conveyed to the transfer portion, the first roller conveying the transfer material by coming into contact with a surface of the transfer material to which the toner image is to be transferred, wherein a triboelectric charge polarity of the first roller when the first roller is triboelectrically charged by contact with the transfer material is opposite to a charge polarity of the photosensitive member;

a first facing roller facing the first roller; and a second roller disposed upstream of the transfer portion and downstream of the first roller in the conveying direction, the second roller conveying the transfer material by coming into contact with the surface of the transfer material to which the toner image is to be transferred, wherein a triboelectric charge polarity of the second roller when the second roller is triboelectrically charged by contact with the transfer material is same as the charge polarity of the photosensitive member, wherein a triboelectric charge polarity of the surface of the first roller when the surface is triboelectrically charged by contact with the first facing roller is same as the triboelectric charge polarity of the surface of the first roller when the surface is triboelectrically charged by contact with the transfer material.

2. The image forming apparatus according to claim 1, further comprising a second facing roller facing the second roller, wherein a triboelectric charge polarity of the surface of the second roller when the surface is triboelectrically charged by contact with the second facing roller is same as the triboelectric charge polarity of the surface of the second roller when the surface is triboelectrically charged by contact with the transfer material.

3. The image forming apparatus according to claim 1, further comprising an endless rotatable transfer belt configured to convey a transfer material, wherein a toner image is transferred, at the transfer portion, from the photosensitive member to the transfer material conveyed by the transfer belt.

4. The image forming apparatus according to claim 3, further comprising a plurality of the image forming units each comprising the photosensitive member.

5. The image forming apparatus according to claim 3, wherein the image forming unit comprises:

an electrostatic-image forming unit that forms an electrostatic image on the photosensitive member; and a developing unit that supplies toner to the electrostatic image formed on the photosensitive member, wherein toner remaining on the photosensitive member after the toner image is transferred from the photosensitive member to the transfer material is recovered by the developing unit.

6. The image forming apparatus according to claim 5, wherein the first roller or the second roller also serves as a registration roller for use in adjusting conveyance timing or position of the transfer material.

7. An image forming apparatus comprising:

an image forming unit configured to form a toner image on a photosensitive member;

a transfer portion configured to transfer the toner image formed by the image forming unit to a transfer material;

a first roller disposed upstream of the transfer portion in a conveying direction of the transfer material conveyed to the transfer portion, the first roller conveying the transfer material by coming into contact with a surface of the transfer material to which the toner image is to be transferred, wherein a triboelectric charge polarity of the first roller when the first roller is triboelectrically charged by contact with the transfer material is opposite to a charge polarity of the photosensitive member; and a second roller disposed upstream of the transfer portion and downstream of the first roller in the conveying direction, the second roller conveying the transfer material by coming into contact with the surface of the transfer material to which the toner image is to be transferred, wherein a triboelectric charge polarity of the second roller when the second roller is triboelectrically charged by contact with the transfer material is same as the charge polarity of the photosensitive member, and wherein a surface of one of the first and second rollers is formed of a material that is more triboelectrically positive than zinc, and a surface of another of the first and second rollers is formed of a material that is more triboelectrically negative than gold.

8. The image forming apparatus according to claim 7, further comprising:

a first friction member disposed in contact with a surface of the first roller; and a second friction member disposed in contact with a surface of the second roller, wherein a triboelectric charge polarity of the surface of the first roller when the surface is triboelectrically charged by contact with the first friction member is same as the triboelectric charge polarity of the surface of the first roller when the surface is triboelectrically charged by contact with the transfer material, and wherein a triboelectric charge polarity of the surface of the second roller when the surface is triboelectrically charged by contact with the second friction member is same as the triboelectric charge polarity of the surface of the second roller when the surface is triboelectrically charged by contact with the transfer material.

9. An image forming apparatus comprising:

an image forming unit configured to form a toner image on a photosensitive member;

a transfer portion configured to transfer the toner image formed by the image forming unit to a transfer material;

a first roller disposed upstream of the transfer portion in a conveying direction of the transfer material conveyed to the transfer portion, the first roller conveying the transfer material by coming into contact with a surface of the transfer material to which the toner image is to be transferred; and a second roller disposed upstream of the transfer portion and downstream of the first roller in the conveying direction, the second roller conveying the transfer material by coming into contact with the surface of the transfer material to which the toner image is to be transferred;

a first friction member disposed in contact with a surface of the first roller; and a second friction member disposed in contact with a surface of the second roller, wherein a triboelectric charge polarity of the surface of the first roller when the surface is triboelectrically charged by the first friction member and a triboelectric charge polarity of the surface of the second roller when the surface is triboelectrically charged by the second friction member differ from each other, and wherein the triboelectric charge polarity of the surface of the second roller when the surface is triboelectrically charged by the second friction member is same as charge polarity of the photosensitive member.

10. The image forming apparatus according to claim 9, wherein the toner image is transferred at the transfer portion from the photosensitive member to the transfer material.

11. The image forming apparatus according to claim 9, further comprising:

a movable intermediate transfer member configured to transfer the toner image transferred from the photosensitive member to the transfer material at the transfer portion; and a cleaning member configured to remove toner from the intermediate transfer member by coming into contact with the intermediate transfer member downstream of the transfer portion and upstream of another transfer portion that transfers the toner image from the photosensitive member to the intermediate transfer member in a moving direction of the intermediate transfer member.

12. The image forming apparatus according to claim 9, further comprising a plurality of the image forming units each comprising the photosensitive member.

13. The image forming apparatus according to claim 9, wherein the first roller or the second roller also serves as a registration roller for use in adjusting conveyance timing or position of the transfer material.

* * * * *